US006363136B1

(12) United States Patent
Flisikowski et al.

(10) Patent No.: US 6,363,136 B1
(45) Date of Patent: Mar. 26, 2002

(54) GRID FOR THE ABSORPTION OF X-RAYS

(75) Inventors: Peter Flisikowski, Vaals (NL); Stefan Schneider, Aachen (DE); Josef Lauter, Geilenkirchen (DE); Herfried Karl Wieczorek, Aachen (DE)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/671,987

(22) Filed: Sep. 28, 2000

(30) Foreign Application Priority Data

Oct. 2, 1999 (DE) ..... 199 47 537

(51) Int. Cl.[7] ..... G21K 1/00
(52) U.S. Cl. ..... 378/154; 378/147; 378/149
(58) Field of Search ..... 378/147, 149, 378/154; 250/505.1, 363.1

(56) References Cited

U.S. PATENT DOCUMENTS

| | | | | | |
|---|---|---|---|---|---|
| 3,988,589 | A | * | 10/1976 | Leask | 250/505 |
| 4,597,096 | A | * | 6/1986 | Larsson | 378/149 |
| 5,099,134 | A | | 3/1992 | Hase et al. | 250/505.1 |
| 5,198,680 | A | * | 3/1993 | Kurakake | 250/505.1 |
| 5,949,850 | A | * | 9/1999 | Tang | 378/154 |
| 6,055,296 | A | * | 4/2000 | Ferlic et al. | 378/154 |

* cited by examiner

*Primary Examiner*—David P. Porta
*Assistant Examiner*—Jurie Yun
(74) *Attorney, Agent, or Firm*—John F. Vodopia

(57) ABSTRACT

In order to increase the ruggedness and the scattered radiation attenuation quality, a grid (3) with comb elements (12) which absorb electromagnetic radiation and are intended to form a grid is constructed, in such a manner that comb lamellae (11) extend transversely of an associated comb base surface which supports the comb lamellae (11).

20 Claims, 6 Drawing Sheets

GRID FOR THE ABSORPTION OF X-RAYS

BACKGROUND OF THE INVENTION

The invention relates to a grid which includes comb elements which absorb electromagnetic radiation and are intended to form a grid.

SUMMARY OF THE INVENTION

Grids of this kind are used in the X-ray technique as anti-scatter grids for absorbing scattered radiation arising in the tissue of the patient before the characteristic X-ray signal, produced by the varying attenuation properties of the tissue examined, is incident on the X-ray detector.

U.S. Pat. No. 5,099,134 discloses a collimator (anti-scatter grid) and a method of manufacturing such a collimator. The collimator is formed by a frame which absorbs X-rays and in which first and second partition plates are arranged. Each of the partition plates is provided with slits which extend in the longitudinal direction of the partition plate and enable the first partition plates to be inserted into the second partition plates at the appropriate angle. The inner sides of the rectangular frame are provided with slits which serve to receive the respective ends of the partition plates.

The complexity of the partition plates imposes given limits on the manufacture of such anti-scatter grids. It has been found that the manufacture of anti-scatter grids of large dimensions, for example as used for large-area detectors, is difficult, because bow of the large partition plates impedes simple and correct meshing of the slits of the partition plates.

Large-area anti-scatter grids are used, for example for multi-line CT (Computed Tomography) apparatus. The length of the detector is then very large. The X-rays emitted by an X-ray source in computed tomography traverse the patient and are attenuated in conformity with the varying thickness and chemical composition of the tissue or bone to be examined. The X-ray signal at the same time is subject to scattered radiation. In order to reduce such scattered radiation which falsifies the primary X-ray image to be formed, the X-rays traverse an anti-scatter grid which is focused onto the focal spot of the radiation source. It is thus achieved that only the X-ray quanta that are characteristic of the attenuation of the irradiated object are detected during the detection of the X-ray quanta.

The construction of CT examination apparatus is such that the radiation source is mounted opposite the detector on a gantry which rotates about the patient, the patient being slowly displaced by means of a flat bed. Vibrations of the gantry, being transferred to the anti-scatter grid and the X-ray detector, have a negative effect on the quality of the image to be formed. Such negative effects cannot be imitated, so that such image falsifying effects can be reduced to a limited extent only during later image processing.

In order to achieve a fast X-ray procedure, the width of the X-ray beam is increased. A larger surface of the object to be examined is thus scanned in a single scan, and hence also a larger volume. However, this has the drawback that the scattered radiation component increases. In order to reduce such an increasing scattered radiation component, the height of the anti-scatter grid is increased. Known anti-scatter grids, however, are not sturdy enough for this purpose.

Therefore, it is an object of the invention to provide an anti-scatter grid which aims to reduce scattered radiation and can be simply manufactured with a sturdiness which also suffices for large-area anti-scatter grids.

This object is achieved in that comb lamellae extend transversely of an associated comb base surface which supports the comb lamellae.

An anti-scatter grid is arranged over the X-ray detector in such a manner that the primary X-rays are incident, via the grid, on a respective detector element arranged therebelow.

The anti-scatter grid consists of a plurality of comb elements which absorb X-rays, are provided with comb structures and are fixed in a frame. The comb elements preferably have a rectangular basic shape and comprise comb lamellae which extend transversely of the surface of a base plate and to the comb base surface formed thereby. These comb lamellae form the comb structure. The comb lamellae are focused onto the focal spot of the radiation source, with the result that the distance between the comb lamellae at the top of the comb element is less than that at the lower side. A plurality of such comb elements is arranged in such a manner that the comb lamellae which extend transversely of the comb base surface border or abut against the nearest comb element by way of the associated comb base surface. This results in a two-dimensional grid structure. The distance between the comb lamellae and the depth of the comb lamellae defines the resolution of the anti-scatter grid. The grid openings of this two-dimensional grid are oriented in the direction of the incident X-rays.

The sides of the individual comb elements are secured in the frame by way of grooves. The number of comb elements to be linked is determined by the dimensions of the X-ray detector used. In the case of CT apparatus, the length of the X-ray detector usually mounts to a number of times its width. It has been found that the comb elements advantageously are so rugged and stable that a large number of comb elements can be arranged in a frame, thus forming a large-area anti-scatter grid which covers a large-area X-ray detector.

In the case of X-ray exposures the X-rays which are characteristic of the region examined are converted in an X-ray detector, for example, into light which itself is either read out by a light-sensitive sensor or is used to expose a film accordingly.

In the case of digital X-ray detectors the image information is read out by sensors. In these discrete exposures it is important that the X-ray quanta of a relevant examination zone to be imaged on a pixel are converted only in the associated detector element and are detected only by the corresponding sensor which is situated therebelow the X-ray quanta that are characteristic of the examination zone corresponding to the resolution of the detector reach the associated detector element directly via the relevant grid opening of the anti-scatter grid. The X-ray quanta that are characteristic of an examination zone corresponding to the resolution of the detector are conducted directly to the associated detector element via the corresponding grid opening in the anti-scatter grid. The radiation scattered in the transverse direction is absorbed by the grid structure of the anti-scatter grid.

The anti-scatter grid in a further embodiment is made of comb elements having a double comb structure and plane lamellae. The comb elements have comb lamellae which extend in the direction transversely of the base plate on both sides of the base plate. The comb lamellae of these double comb elements extend transversely of the two comb base surfaces to both sides of the base plate. For the anti-scatter grid a double comb element and a plane lamella are linked each time in an alternating fashion. This again results in a grid. The double comb elements and the lamellae are retained by the frame.

The comb lamellae of the comb elements are oriented so as to be focussed onto the focal spot of the radiation source. The X-rays are incident on the anti-scatter grid at a given angle. Because the direct X-rays should pass the anti-scatter grid without impediment, the orientation of the grid must be adapted to the radiation angle. To this end, the distances between the comb lamellae at the top of the comb elements are smaller than the distances between the comb lamellae at the bottom of the comb elements.

Moreover, in the case of curved X-ray detectors it is also necessary to adapt the anti-scatter grid to the curvature of the X-ray detector. To this end, the depth of the comb lamellae increases towards the lower side of the comb element, so that a curvature corresponding to the curvature of the X-ray detector is obtained upon assembly of a plurality of comb elements.

The frame in which the comb elements are secured is adapted to the shape of the X-ray detector. Grooves are provided on the inner sides of the frame. The thickness of the grooves corresponds to the wall thickness of the comb elements, so that they are retained by the shape of the grooves. Additionally, the comb elements can be glued in said grooves.

The object according to the invention is also achieved by means of a detector with a grid for the absorbtion of X-rays.

Furthermore, the object of the invention is also achieved by means of an X-ray apparatus which includes a grid for the absorption of X-rays which is arranged in front of the detector.

The object according to the invention is also achieved by means of a method of manufacturing a grid which includes comb elements which absorb electromagnetic radiation, the comb elements with comb lamellae extending perpendicularly to an associated comb base surface supporting the comb lamellae being arranged in such a manner that they form a two-dimensional grid.

Embodiments of the invention will be described in detail hereinafter with reference to the drawing. Therein:

DESCRIPTION OF THE PREFERRED EMBODIMENTS

Figure 1:
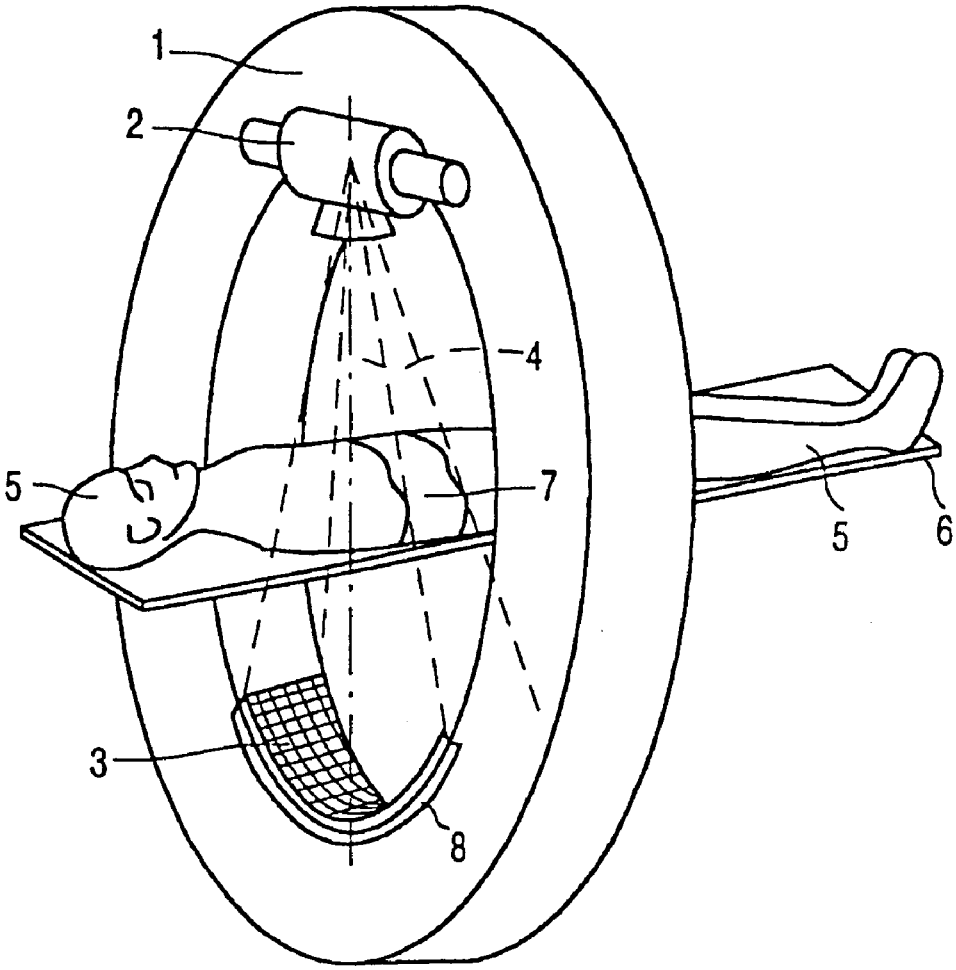
FIG. 1 shows a computed tomography apparatus with a grid arranged over the detector.

FIG. 1 shows a computed tomography apparatus which includes a gantry 1 on which a radiation source 2 is mounted. The X-ray detector 8 with the anti-scatter grid 3 arranged thereabove is mounted so as to face the radiation source 2. A patient 5 on a table 6 is introduced into the beam path 4. The gantry 1 rotates about the patient 5. An examination zone 7 is thus irradiated from all sides. The patient 5 is slid through the rotating gantry in the horizontal direction, so that a volume image is acquired by way of a plurality of cross-sectional images. The zone scanned during one rotation is substantially larger in the case of two-dimensional X-ray detectors 8 than in the case of single-line X-ray detectors. As a result, the patient 5 can be slid through the gantry 1 faster.

Figure 2:
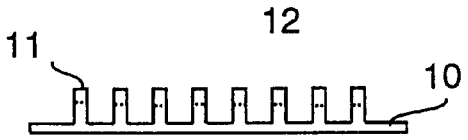
FIG. 2 is a plan view of a one-sided comb element.

The FIGS. 2 to 5 show a one-sided comb element 12 in several views. FIG. 2 is a plan view of a one-sided comb element 12. This one-sided comb element 12 is made of a material absorbing X-rays, for example brass, molybdenum, tungsten. The comb structure of the comb element 12 is formed by comb lamellae 1I1 which extend transversely of a base plate 10. The height of the comb element 12 is dependent on the specific application. A decisive criterion in this respect is the surface area irradiated by one scan. The ratio of useful radiation to scattered radiation becomes worse as the width of the surface irradiated by the X-rays per scan increases. The comb elements 12 typically have a height of from approximately 2 to 6 cm. The more scattered radiation is contained in the overall signal, the higher the anti-scatter grid must be. The width of the comb element 12, or also of the base plate 10, is governed by the width of the X-ray detector 8. An anti-scatter grid 3 as constructed from such comb elements 12 must completely cover the X-ray detector 8. In the case of large-area flat X-ray detectors, therefore, the comb elements 12 are wider than in the case of the narrower multi-line or two-dimensional X-ray detectors 8 used in computed tomography. The depth of the comb lamellae 11 and the distance D between the individual comb lamellae 11 define the pixel size of such an anti-scatter grid 3. In the case of two-dimensional X-ray detectors 8 for computed tomography apparatus the pixel size amounts to from approximately 1×1 to 2×5 $mm^2$.

A plurality of comb elements 12 are oriented relative to the incident X-rays in such a manner that the X-rays pass through the grid openings formed by the comb lamellae 11 and the base plate 10.

Figure 4:
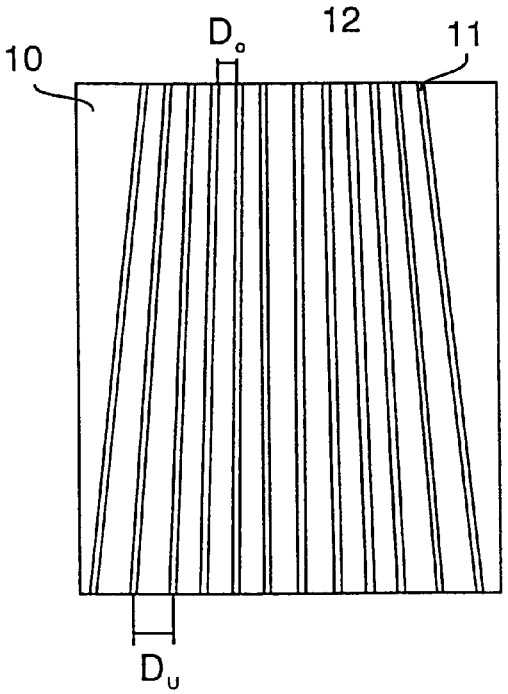
FIG. 4 is a front view of a one-sided comb element.
Figure 5:
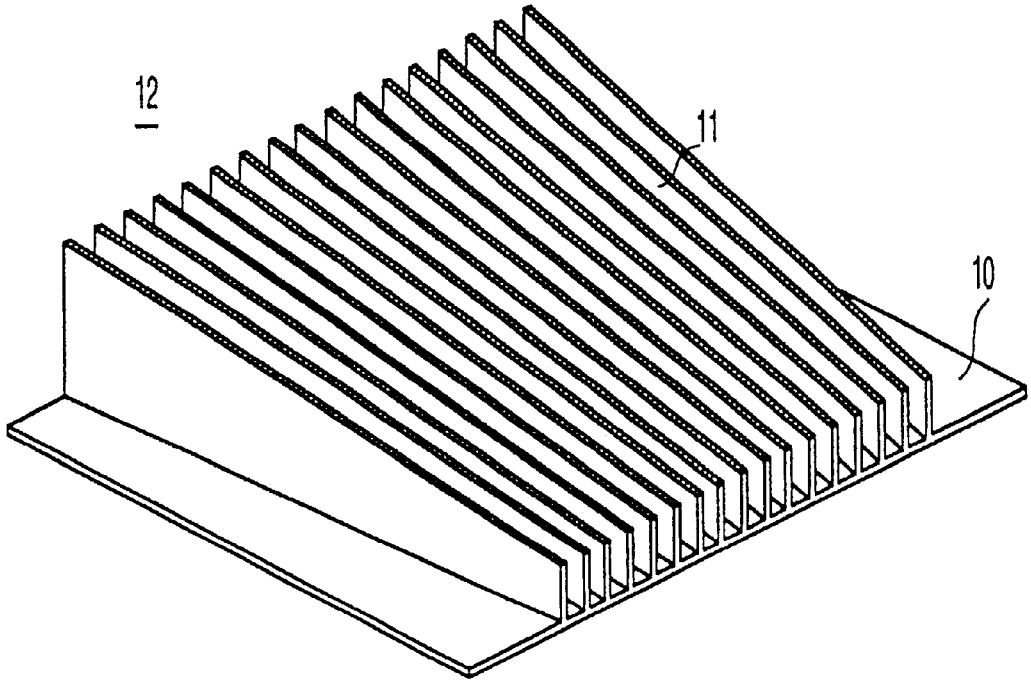
FIG. 5 is a perspective view of a one-sided comb element.

X-rays are emitted by the X-ray source with a focal spot and emanate at a radiation angle from this spot. In order to achieve effective filtering or an as good as possible primary radiation transparency, the comb lamellae 11 are arranged on the base plate 11 so as to be oriented towards or focused on this focal spot. This is shown in FIG. 4. The distance $D_o$ between the comb lamellae 11 at the upper edge of the base plate 10 is smaller than the distance $D_u$ between the comb lamellae 11 at the lower edge of the base plate 10.

Figure 3:
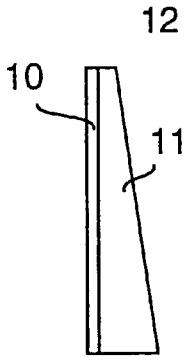
FIG. 3 is a side elevation of a one-sided comb element.

Because the X-ray detectors 8 in computed tomography apparatus are adapted to a curvature, it is necessary to adapt the anti-scatter grid 3 accordingly. FIG. 3 shows that the depth of the comb lamellae 11 at the upper edge is less than that at the lower edge of the base plate 10. Piece-wise assembly of small anti-scatter grid segments is possible in the case of long X-ray detectors.

Figure 6:
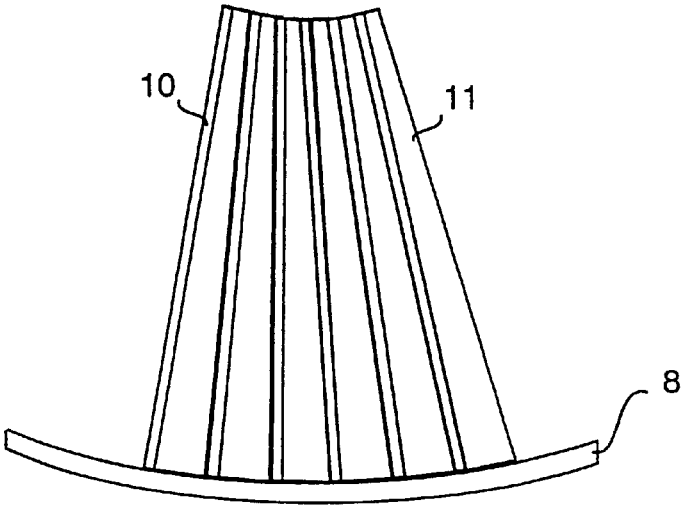
FIG. 6 is a side elevation of a plurality of one-sided comb elements arranged over the detector.

FIG. 6 illustrates the linking of a plurality of one-sided comb elements 12. Due to the different depths of the comb lamellae 11 at the upper edge and the lower edge (FIG. 3), the anti-scatter grid 3 can be readily adapted to the curvature of the X-ray detector 8. The curvature of the anti-scatter grid 3 is also imposed by the arrangement of the grooves 14 in the frame 13.

Figure 7:
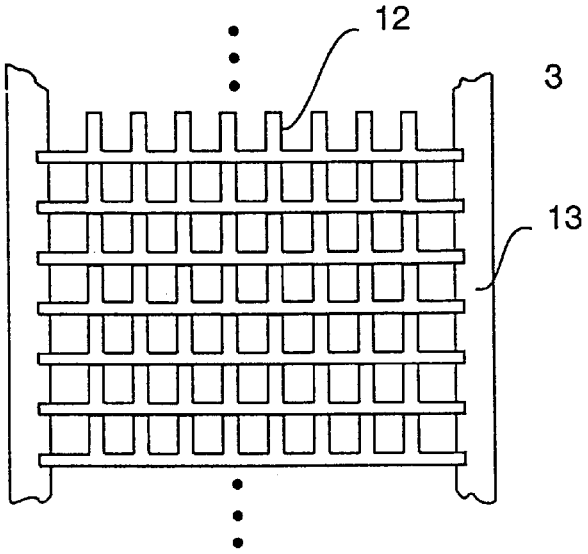
FIG. 7 shows an anti-scatter grid consisting of one-sided comb elements.
Figure 8:
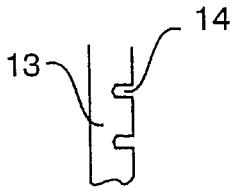
FIG. 8 shows a part of a frame with grooves.

FIG. 7 illustrates the arrangement of a plurality of one-sided comb elements 12 in a frame 13 which produces an X-ray shadow. The inner side of the frame 13 is provided with grooves 14 which are shown in FIG. 8. The grooves 14 receive the sides of the base plates 10 of the plurality of one-sided comb elements 12. The comb elements 12 can be glued in or be secured in any other feasible manner. Mechanical fixation by pressing in the comb elements 12 is also feasible. An anti-scatter grid 3 is formed by linking a plurality of onesided comb elements 12. The comb lamellae 11 of one base plate 10 then adjoin the rear side of a neighboring base plate 10. The length of such an anti-scatter grid 3 can be increased at will by selection of the number of comb elements 12.

Figure 9:
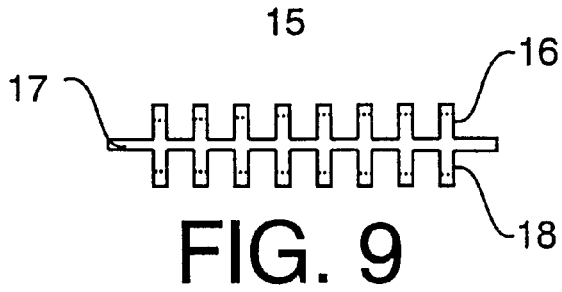
FIG. 9 is a plan view of a two-sided comb element.
Figure 10:
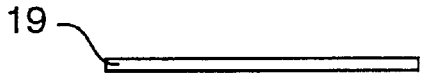
FIG. 10 is a plan view of lamellae.

A further embodiment of an anti-scatter grid 3 will be described in detail hereinafter. The FIGS. 9 to 12 show a two-sided comb element 15 and an anti-scatter grid 3 assembled from such elements and lamellae 19. FIG. 9 shows a two-sided comb element 15 with a double comb structure. It consists of a base plate 17 on both sides of which there are provided lamellae 16 and 18. The comb lamellae 16 and 18 are arranged on both sides of the base plate 17 so as to extend transversely of the comb base surface formed by the base plate 17. The above configurations for the focusing of the one-sided comb element 12 are to be used accordingly for this two-sided comb element 15. Moreover, in order to imitate the curvature of the X-ray detector 8, the comb lamellae 16 and 18 are deeper at the lower side of the base plate 17 than the comb lamellae 16 and 18 at the upper edge of the base plate 17.

Figure 11:
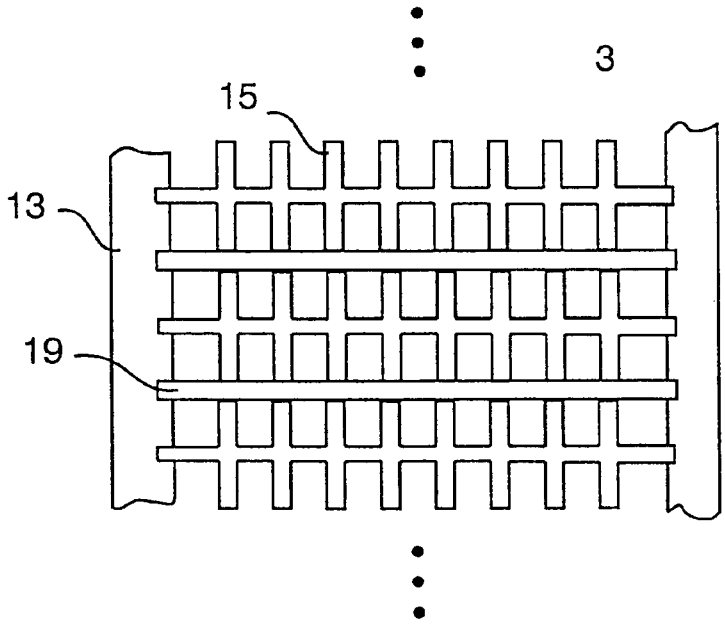
FIG. 11 shows an anti-scatter grid consisting of two-sided comb elements and lamellae.
Figure 12:
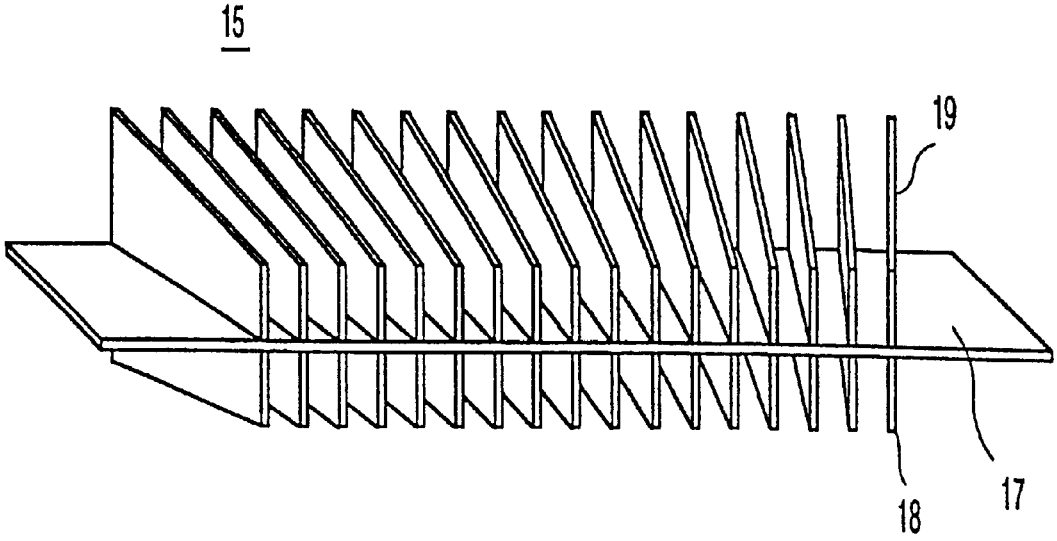
FIG. 12 is a perspective view of a two-sided comb element.

FIG. 11 shows the assembly of plane lamellae 19 (FIG. 10) and two-sided comb elements 15. Two-sided comb elements 15 and lamellae 19 are fitted in an alternating arrangement in a frame 13, thus forming an anti-scatter grid 3. The comb lamellae 16 and 18 adjoin the respective neighboring lamellae 19. The length of the anti-scatter grid 3 can again be increased by increasing the number of two-sided comb elements 15 and lamellae 19 used.

Anti-scatter grids are used not only for computed tomography but also for radiology. In that case the anti-scatter grid 3 need not be curved, because the X-ray detector 8 is flat. Such anti-scatter grids typically have dimensions other than the grids described thus far. In these fields of application, however, fewer vibrations occur. The frames of these anti-scatter grids are larger and the comb elements 12 or 15 to be used are also larger. Because of the very high natural stability of the comb elements 15, such an embodiment of an anti-scatter grid is suitable for a very large range of applications.

Several methods are available for the manufacture of such comb elements 15. Depending on the resolution or pixel size of the anti-scatter grid, the comb elements 12 or 15 can be formed, for example by means of milling, sintering or injection molding. In the case of the injection-molding method materials absorbing X-rays can be added to a basic material.

An anti-scatter grid 3 can also be formed by linking two-sided comb elements 15 without arranging lamellae 19 therebetween.

Instead of using a frame 13, the comb elements 12 or 15 can also be arranged while using spacers in such a manner that an anti-scatter grid is formed.

Such an anti-scatter grid can be adapted to special applications by varying the distances between the comb lamellae of the comb elements. For example, it is feasible to realize a higher resolution for an inner or core area of an anti-scatter grid; this can be achieved by means of a grid with very fine meshes. The resolution could be lower at the edge area of the X-ray detector that is covered by the anti-scatter grid, so that at this area the grid openings in the anti-scatter grid may be larger.

What is claimed is:

1. A grid for absorbing electromagnetic radiation comprising:

a plurality of comb elements, each comb element of the plurality of comb elements having a rigid and substantially flat base upon which comb lamellae extend transversely, the comb lamellae having a height perpendicular to the base, wherein the plurality of comb elements are arranged such that the lamellae of each comb element abuts a flat surface of the flat base of an adjacent comb element to form a grid structure having apertures having an interior dimension that equals the height of the lamellae.

2. A grid for absorbing electromagnetic radiation comprising:

a plurality of comb elements, each comb element of the plurality of comb elements having a rigid and substantially flat base upon which comb lamellae extend transversely on each of two opposing surfaces of the flat base, the comb lamellae having a height perpendicular to the base, and a plurality of rigid and substantially flat separating elements, wherein the plurality of comb elements are arranged such that the lamellae of each comb element abuts a flat surface of a corresponding element of the plurality of separating elements to form a grid structure having apertures having an interior dimension that equals the height of the lamellae.

3. A grid as claimed in claim 1, characterized in that the lamellae form a comb structure of the plurality of comb elements that is focused on a focal spot.

4. A grid as claimed in claim 1, characterized in that the plurality of comb elements are secured in a frame by way of grooves at edges of the frame.

5. A grid as claimed in claim 4, characterized in that the plurality of comb elements are glued in the grooves.

6. A grid as claimed in claim 1, characterized in that the plurality of comb elements absorb X-rays.

7. A focused detection system comprising:

a detector that is configured to detect X-rays, and a grid for the absorption of X-rays that includes:

a plurality of comb elements, each comb element of the plurality of comb elements having a rigid and substantially flat base upon which comb lamellae extend transversely, the comb lamellae having a height perpendicular to the base, wherein the plurality of comb elements are arranged such that the lamellae of each comb element abuts a flat surface of the flat base of an adjacent comb element to form a grid structure having apertures having an interior dimension that equals the height of the lamellae, such that X-rays that enter the apertures substantially normal to the grid are detected by the detector, and X-rays that enter the apertures at a non-normal angle to the grid are absorbed by the grid.

8. An X-ray apparatus which includes a grid which is arranged in front of a detector in order to absorb X-rays, wherein the grid includes:

a plurality of comb elements, each comb element of the plurality of comb elements having a rigid and substantially flat base upon which comb lamellae extend transversely, the comb lamellae having a height perpendicular to the base, wherein the plurality of comb elements are arranged such that the lamellae of each comb element abuts a flat surface of the flat base of an adjacent comb element to form a grid structure having apertures having an interior dimension that equals the height of the lamellae, such that X-rays that enter the apertures substantially normal to the grid are detected by the detector, and X-rays that enter the apertures at a non-normal angle to the grid are absorbed by the grid.

9. A method of manufacturing a grid that is configured to absorb electromagnetic radiation, comprising:

providing a plurality of comb elements, each comb element of the plurality of comb elements having a rigid and substantially flat base upon which comb lamellae extend transversely, the comb lamellae having a height perpendicular to the base, and arranging the plurality of comb elements such that the lamellae of each comb element abuts a flat surface of the flat base of an adjacent comb element to form a grid structure having apertures having an interior dimension that equals the height of the lamellae.

10. A method of manufacturing a grid that is configured to absorb electromagnetic radiation, comprising:

providing a plurality of comb elements, each comb element of the plurality of comb elements having a rigid and substantially flat base upon which comb lamellae extend transversely on each of two opposing surfaces of the base, the comb lamellae having a height perpendicular to the base, providing a plurality of rigid and substantially flat separating elements, arranging the plurality of comb elements such that the lamellae of each comb element abuts a flat surface of a corresponding element of the plurality of separating elements, to form a grid structure having apertures having an interior dimension that equals the height of the lamellae.

11. A grid as claimed in claim 2, characterized in that the lamellae form a comb structure of the plurality of comb elements that is focused on a focal spot.

12. A grid as claimed in claim 2, characterized in that the plurality of comb elements and separating elements are secured in a frame by way of grooves at edges of the frame.

13. A grid as claimed in claim 12, characterized in that the plurality of comb elements and separating elements are glued in the grooves.

14. A grid as claimed in claim 2, characterized in that the plurality of comb elements absorb X-rays.

15. A focused detection system comprising:

a detector that is configured to detect X-rays, and a grid for the absorption of X-rays that includes:

a plurality of comb elements, each comb element of the plurality of comb elements having a rigid and substantially flat base upon which comb lamellae extend transversely on each of two opposing surfaces of the flat base, the comb lamellae having a height perpendicular to the base, and a plurality of rigid and substantially flat separating elements, wherein the plurality of comb elements are arranged such that the lamellae of each comb element abuts a flat surface of a corresponding element of the plurality of separating elements to form a grid structure having apertures having an interior dimension that equals the height of the lamellae, such that X-rays that enter the apertures substantially normal to the grid are detected by the detector, and X-rays that enter the apertures at a non-normal angle to the grid are absorbed by the grid.

16. An X-ray apparatus which includes a grid which is arranged in front of a detector in order to absorb X-rays, wherein the grid includes:

a plurality of comb elements, each comb element of the plurality of comb elements having a rigid and substantially flat base upon which comb lamellae extend transversely on each of two opposing surfaces of the flat base, the comb lamellae having a height perpendicular to the base, and a plurality of rigid and substantially flat separating elements, wherein the plurality of comb elements are arranged such that the lamellae of each comb element abuts a flat surface of a corresponding element of the plurality of separating elements to form a grid structure having apertures having an interior dimension that equals the height of the lamellae, such that X-rays that enter the apertures substantially normal to the grid are detected by the detector, and X-rays that enter the apertures at a non-normal angle to the grid are absorbed by the grid.

17. An X-ray apparatus according to claim 16, wherein the height of the lamellae is tapered along a transverse axis of the base.

18. An X-ray apparatus according to claim 8, wherein the height of the lamellae is tapered along a transverse axis of the base.

19. A grid according to claim 1, wherein the height of the lamellae is tapered along a transverse axis of the base.

20. A grid according to claim 2, wherein the height of the lamellae is tapered along a transverse axis of the base.

* * * * *